US007775951B2

(12) United States Patent
Chu

(10) Patent No.: US 7,775,951 B2
(45) Date of Patent: Aug. 17, 2010

(54) INTEGRATED LEG PRESS FOR GYM

(76) Inventor: Yong S. Chu, 1225 Raymond Ave., Glendale, CA (US) 91201

( * ) Notice: Subject to any disclaimer, the term of this patent is extended or adjusted under 35 U.S.C. 154(b) by 0 days.

(21) Appl. No.: 12/317,121

(22) Filed: Dec. 19, 2008

(65) Prior Publication Data

US 2009/0170674 A1 Jul. 2, 2009

Related U.S. Application Data

(60) Provisional application No. 61/009,505, filed on Dec. 28, 2007.

(51) Int. Cl.
*A63B 21/00* (2006.01)

(52) U.S. Cl. ..... 482/138; 482/133; 482/135

(58) Field of Classification Search ..... 482/93, 482/99, 100, 133–138, 72, 95, 96; 297/85 R, 297/89, 259.2
See application file for complete search history.

(56) References Cited

U.S. PATENT DOCUMENTS 3,058,775 A * 10/1962 Schliephacke Fridtjof F . 297/89
3,140,893 A * 7/1964 Schliephacke Fridtjof F . 297/85 R
4,544,201 A * 10/1985 Rogers, Jr. ..... 297/259.2
4,627,617 A * 12/1986 Gilmore et al. ..... 482/92
5,330,405 A * 7/1994 Habing et al. ..... 482/96
5,342,269 A * 8/1994 Huang et al. ..... 482/95
5,366,432 A * 11/1994 Habing et al. ..... 482/138
5,411,453 A 5/1995 Wilson
5,549,533 A 8/1996 Olson
5,554,086 A 9/1996 Habing
5,616,107 A 4/1997 Simonson
5,906,566 A * 5/1999 Whitcomb ..... 482/130
5,961,427 A * 10/1999 Habing et al. ..... 482/96
6,120,419 A * 9/2000 Huang ..... 482/96
6,533,710 B2 3/2003 Lin
6,605,024 B2 8/2003 Stearns
6,659,919 B2 * 12/2003 Deola ..... 482/99
6,743,158 B2 6/2004 Giannelli
7,070,545 B2 * 7/2006 Lull et al. ..... 482/100
2002/0028733 A1 * 3/2002 Martens ..... 482/99
2006/0240957 A1 * 10/2006 Lull et al. ..... 482/94

* cited by examiner

*Primary Examiner*—Loan Thanh
*Assistant Examiner*—Allana Lewin
(74) *Attorney, Agent, or Firm*—Clement Cheng

(57) ABSTRACT

The present invention is a lower body workout apparatus that is a part of a gym and supports leg press exercise feature and may be combined with a leg extension/curl feature. The seat on the apparatus or the feature station may be used with upper body exercises. The apparatus comprises a base frame that is on a floor surface and can be a part of a gym unit frame, and a seat frame that supports a seat pad and moves relative to the base frame, a guide that relates the seat frame to the base frame mechanically and guides the motion of the seat frame relative to the base frame, and a cable system comprising a force source that relates either the seat frame or the guide or both to the base frame.

14 Claims, 4 Drawing Sheets

INTEGRATED LEG PRESS FOR GYM

CROSS-REFERENCES TO RELATED APPLICATIONS

This application is entitled to the benefit of Provisional Patent Application Ser. No. 61/009,505 filed on Dec. 28, 2007.

BACKGROUND OF THE INVENTION

1. Field of the Invention

This invention relates generally to exercise equipment for working out lower parts of a person's body, particularly focusing on development of leg muscles and is an integral part of a gym unit that also supports other exercise features.

2. Description of Related Art Including Information Disclosed Under 37 CFR 1.97 and 1.98

A number of stand-alone leg press exercise machines and leg press exercise stations as a part of multi-exercise gym equipments have been introduced in the field of the art. U.S. Pat. No. 5,366,432 to Habing shows a leg press machine utilizing a four-bar linkage mechanism on a foot pedal to provide a motion for the legs of the user who sits on a stationary seat pad and against a stationary back pad. U.S. Pat. No. 5,411,458 to Giust shows a horizontal squat apparatus that has a stationary foot pedal and a carriage which carries the user on an inclined track. U.S. Pat. No. 5,549,533 to Olson shows a combination leg station of leg press and leg extension exercises, however this setup eliminates leg curl exercise feature, another important leg exercise for a multi-exercise gym. U.S. Pat. No. 5,554,086 to Habing shows a compact attachment for performing leg press for a multi-station exercise machine. Seat pad is on a moving frame that is coupled to a stationary frame by either a four-bar linkage system or a track. U.S. Pat. No. 5,616,107 to Simonson shows another leg press apparatus with a foot pedal on a four-bar linkage which moves away from its seat pad on a seat frame which is also movable and linked to the four-bar linkage of the pedal. U.S. Pat. No. 6,533,710 to Lin shows a hip exerciser with a movable seat pad on a five-pivot linkage providing some random motion to the seat. Pedals also move independently from the seat. And there are more leg press and lower body exercise machines related to the invention disclosed in the field. Each has advantages and disadvantages respect to other designs, however none of the prior arts shows a simple way to integrate the leg press exercise in a multi-exercise gym with a good motion profile and without compromising other exercise features in the multi-exercise gym.

SUMMARY OF THE INVENTION

The present invention teaches certain benefits in construction and use which give rise to the objectives described below.

The present invention is a lower body workout apparatus or station that is a part of a gym unit and supports mainly leg press exercise feature and can support indirectly other exercise features that can be performed near or around the apparatus or the station. The feature station may be combined with a leg extension/curl feature, as shown in the primary embodiment, or other exercises such as multi-hip exercise or inner/outer thigh exercise feature. The seat on the apparatus or the feature station may be used with upper body exercises such as chest press, shoulder press, or pectoral fly exercise features. The apparatus comprises a base frame that is on a floor surface and can be a part of a gym unit frame, and a seat frame that supports a seat pad and moves relative to the base frame.

The apparatus further comprises a guide that relates the seat frame to the base frame mechanically and guides the motion of the seat frame relative to the base frame, and a cable system with a force source that relates either the seat frame or the guide or both to the base frame so that a displacement of the seat frame along its motion path causes the force source to react, providing a resistance.

A primary objective of the present invention is to provide an apparatus having advantages not taught by the prior art.

Another objective is to provide such an apparatus that is structurally integrated into a gym unit.

Another objective is to provide such an apparatus that is relatively low cost to manufacture by utilizing and sharing framework and parts used with other exercise features near or around the apparatus.

Another objective is to provide such an apparatus that helps a gym unit maintain its footprint as compact as possible by having the leg press mechanism over the existing framework of the gym unit.

Another objective is to provide such an apparatus that can easily be combined with other lower body exercise features.

Other features and advantages of the present invention will become apparent from the following more detailed description, taken in conjunction with the accompanying drawings, which illustrate, by way of example, the principles of the invention.

DETAILED DESCRIPTION OF THE INVENTION

The present invention teaches certain benefits in construction and use that gives rise to the objectives described below.

The present invention is an exercise machine or a part of the exercise machine that offers leg exercises including leg press, leg extension, and leg curl exercises in a same station with a minor setup change for performing each exercise. Unlike other leg press units, in the prior arts, that are either mounted to a side of a gym unit, thus making the gym larger in footprint, or bulky combination of leg extension and leg press at the front of the station, thus making the leg extension or leg curl exercises cumbersome, the present invention nicely goes into the existing structure of a gym unit without making the gym unit bigger or affecting any other feature.

Figure 1:
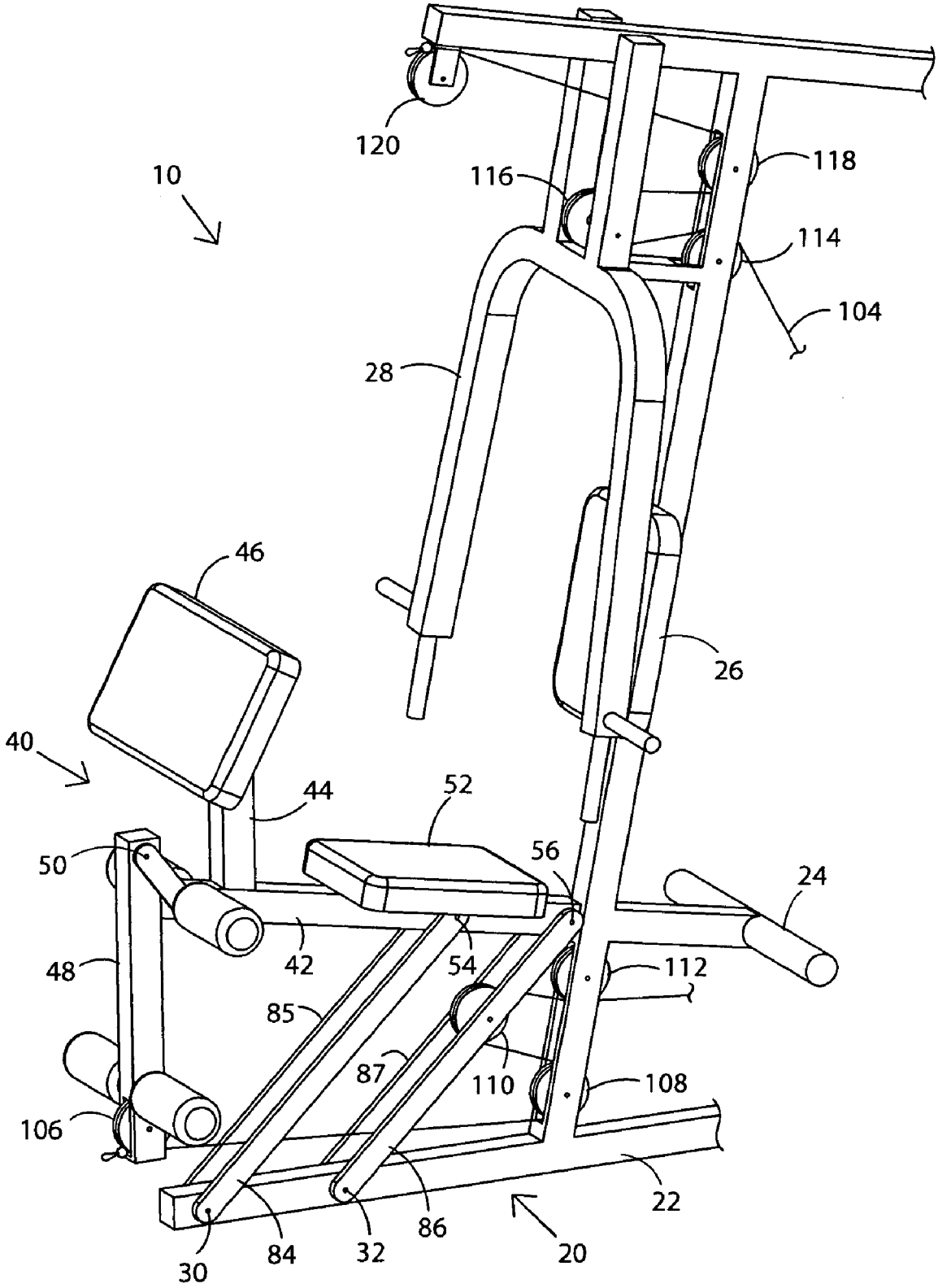
FIG. 1 is a perspective view of the present invention showing a part of a gym unit showing a leg station.

An integrated leg press 10 includes a base assembly 20 standing on a floor surface and comprising a base frame 22 which provides a stationary structure to support other components such as a back pad 26 and a pedal 24 as shown in FIG. 1. In general, base assembly 20 is a part or a station of a home gym that includes a cable system 100, in FIG. 2, connected to a resistance source 140 such as a group of weight plates that the user can select and set the amount of weight for performing exercises or any other resistance means well-known in the field of the art. In FIG. 1, a leg station 40 is combined with a press arm 28 above, but leg station 40 may also be combined with a pectoral fly feature or other upper body exercise features. Even though they can be on the same leg station side possibly sharing a common cable system and the leg station provides supporting pads for the user to sit down, the upper body exercise features usually operate independently of leg exercise features. The upper body exerciser is attached to the base assembly. The upper body exerciser can be a number of different mechanisms for exercising a variety of upper body muscles, such as a fly exercise or, a pull down bar for exercising shoulder muscles, or the chest press shown in the drawings.

Figure 2:
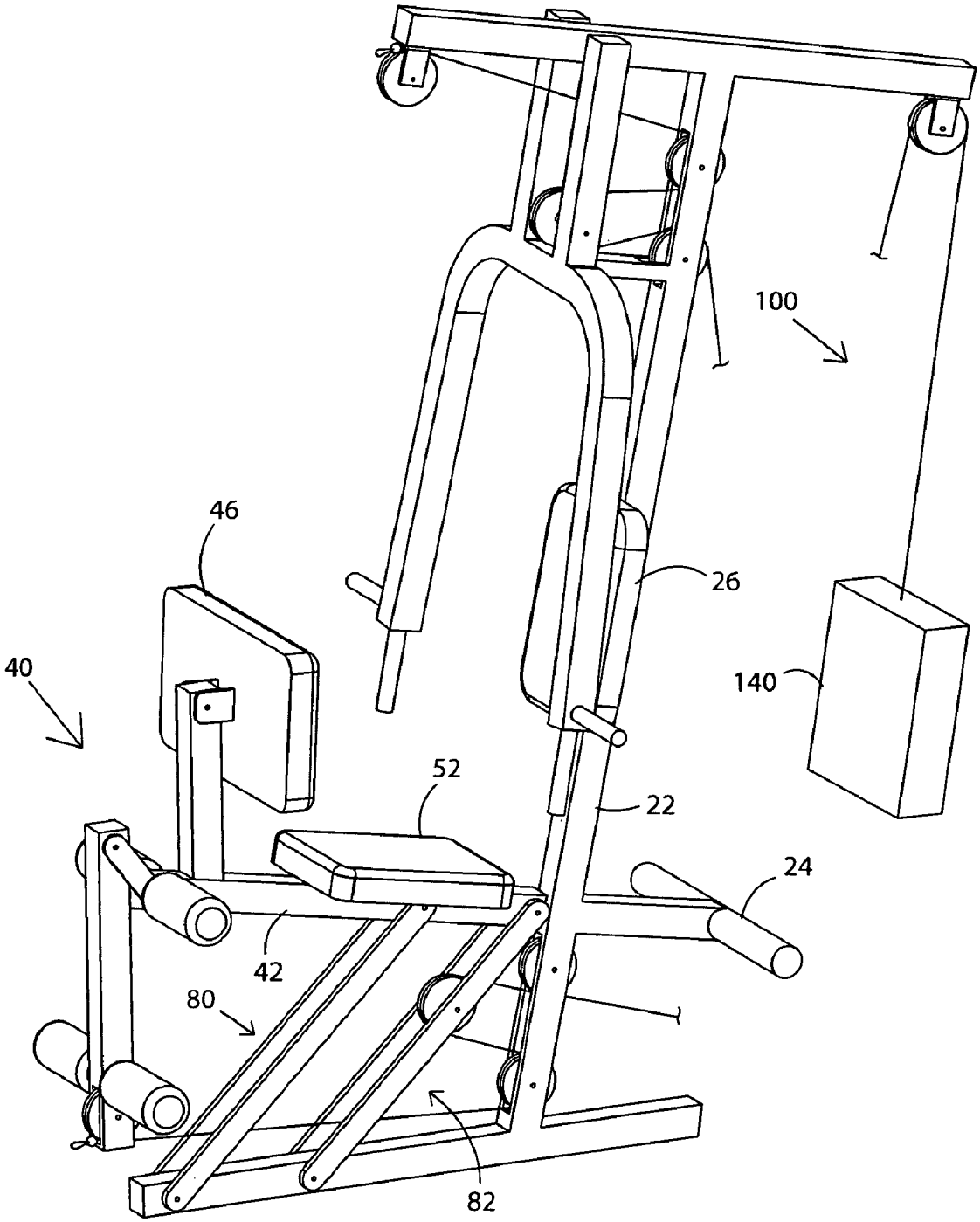
FIG. 2 is another perspective view of the present invention showing an initial position of the leg press exercise.

Base assembly 20 further comprises a first base pivot 30 and a second base pivot 32 near the floor side of base frame 22. In FIGS. 1 and 2, a first link 80 is pivotally connected to first base pivot 30 at its one end and also pivotally connected to a first leg press pivot 54 on a seat frame 42 of leg station 40 at the other end. A second link 82 is pivotally connected to second base pivot 32 at its one end and pivotally connected at the other end to a second leg press pivot 56 on seat frame 42. Seat frame 42 of leg station 40 shown in FIG. 1 supports a pad support 44, a simple frame to hold a pad 46 at different angles. FIG. 1 shows pad 46 at an arm-curl position where the user puts elbows on the pad and performs an arm-curl exercise possibly pulling the cable end of a first cable 102. The front end of seat frame 42 is a leg extension pivot 50 pivotally holding a leg extension arm 48 at its upper end, and leg extension arm 48 rests on the front part of the seat frame at a distance away from pivot 50 as a starting point of its motion. A seat pad 52 is placed on seat frame 42 to provide a seating surface for the user. The leg extension arm and leg extension pivot and front end of seat frame 42 are elements of the leg developer. The front end of the seat frame 42 is the front end of the leg station.

First cable 102 and a second cable 104 are parts of cable system 100 that includes at least one resistance source such as a selectable weight stack or a weight plate loadable bar on a guide rail, as well known in the field of the art. Multiple independent resistance sources, each resistance for a selected feature or a station, in a gym unit are also common in the field of the art. FIG. 1 shows only the parts of the cable system for operating a station that includes the integrated leg press with a possibility of having the press arm on the same side. In FIG. 1, first cable 102 starts at a leg extension pulley 106 at the lower end of leg extension arm 48, goes to a first base pulley 108, next to a leg press pulley 110, next to a second base pulley 112, and goes into the rest of cable system 100. This is one possible cable route for leg station 40 and other cable routing options along with different arrangement of pulley placement are feasible with the mechanism.

Second cable 104 in FIG. 1 starts at a fifth base pulley 120, goes to a fourth base pulley 118, to a press arm pulley 116, to a third base pulley 114, and goes into the rest of cable system 100. This is a well-known cable route in the field of the art for a press arm in a gym unit.

Figure 3:
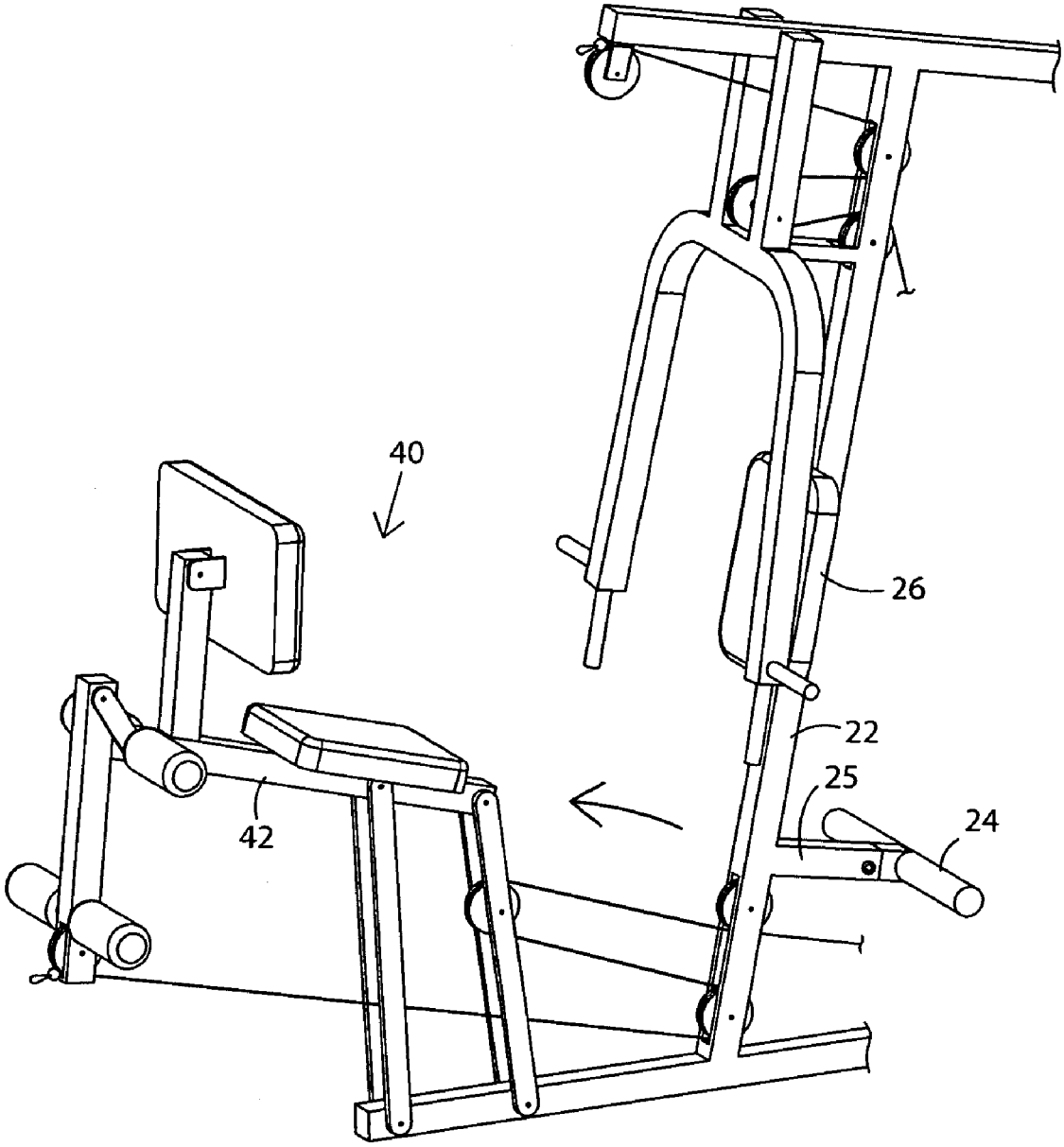
FIG. 3 is another perspective view of the present invention showing an end position of the leg press exercise.

In order to perform the leg press exercise on leg station 40, pad 46 is flipped toward the seat pad as shown in FIG. 2. This way pad 46 supports the user's back when the user sits facing toward back pad 26 and puts her/his feet on pedal 24. In this case, pad 46 has two purposes of supporting arms when performing arm-curl exercise and supporting the user's back when performing leg press exercise. However, pad 46 may be fixed at the position for supporting the back of the user for leg press exercise only as shown in FIG. 2, and both pad 46 and pad support 44 may be removable to clear the way when other exercises are performed. With pad 46 positioned to support the user's back and seat frame 42 resting on base frame 22 as shown in FIG. 2, the leg station is in its starting position of leg press exercise. As the user pushes pedal 24 with her/his feet by stretching the legs, seat frame 42 of leg station 40 is lifted off from its resting position on base frame 22 and seat frame travels away from the portion of the base frame where back pad 26 is mounted on, as shown in FIG. 3. A pedal arm 25 of base assembly 20 can be an adjustment arm to selectively position pedal 24 for the user preference, not shown. The adjustment can include angular positions or closer or further positions or both combined to fixedly reposition pedal 24 relative to seat pad 52 at the leg press feature in rest position.

Figure 4:
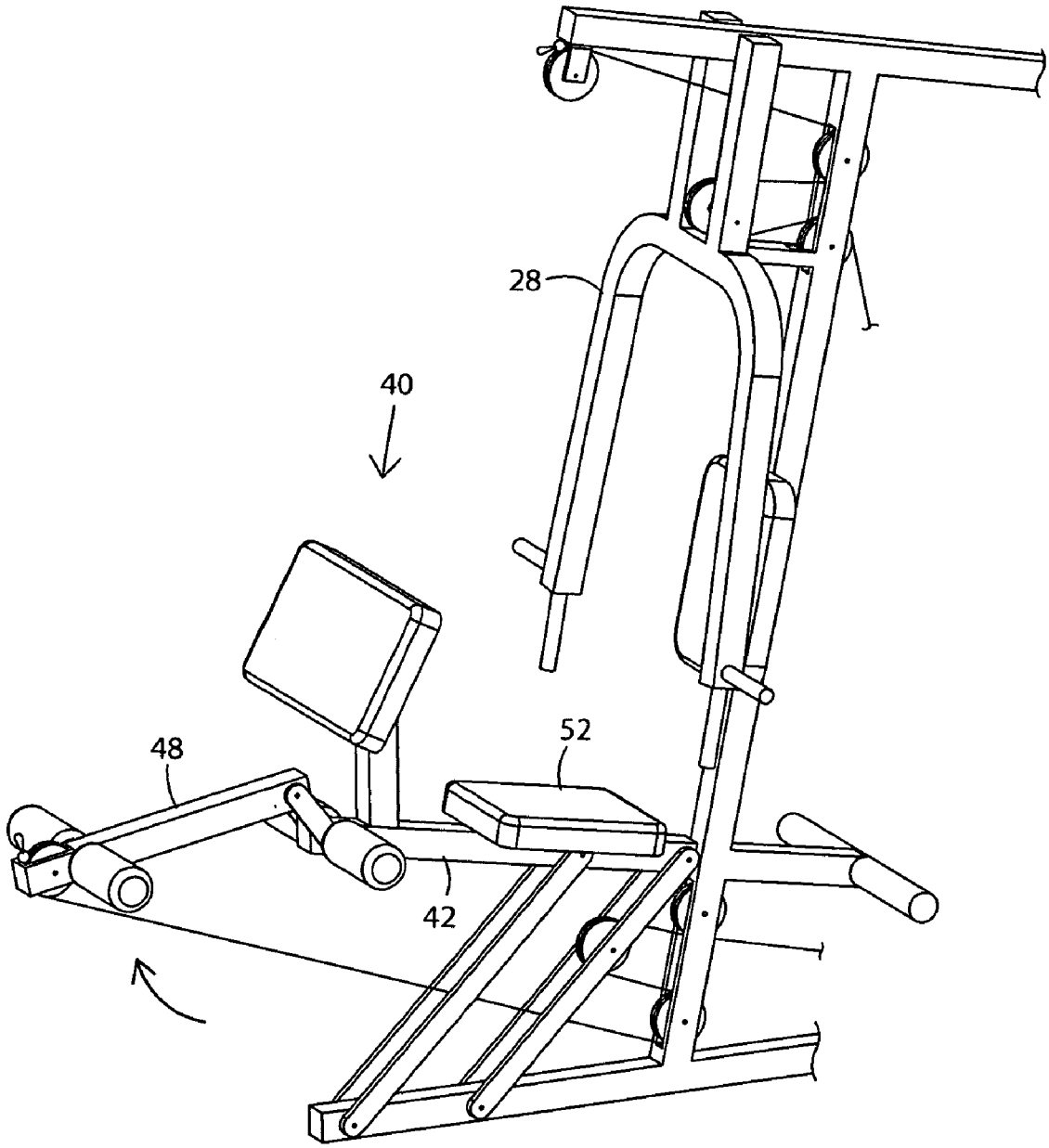
FIG. 4 is another perspective view of the present invention showing leg extension/curl exercise on the leg station.

FIG. 4 shows the leg extension arm being used on leg station 40. The user may sit on seat pad 52 facing toward leg extension arm 48 for performing leg extension exercise or stand in front of leg station 40 facing toward press arm 28 for performing standing leg curl exercise using the leg extension arm, as well-known in the field of the art. As shown in the figure, seat frame 42 is at its rest position of leg press exercise while the leg extension/curl exercise is performed. This embodiment shows the leg station that includes the leg extension/curl feature, however it is also possible that the leg press feature alone may be installed on the leg station without the leg extension/curl feature or may be combined with other leg exercise features in the leg station.

Although the invention has been disclosed in detail with reference only to the above embodiments, those skilled in the art will appreciate that various other embodiments can be provided without departing from the scope of the invention. Accordingly, the invention is defined only by the claims set forth below.

CALL OUT LIST OF THE ELEMENTS

10 Integrated Leg Press
20 Base Assembly
22 Base Frame
24 Pedal
25 Pedal Arm
26 Back Pad
28 Press Arm
30 First Base Pivot
32 Second Base Pivot
34 Press Arm Pivot
40 Leg Station
42 Seat Frame
44 Pad Support
46 Pad
48 Leg Extension Arm
50 Leg Extension Pivot
52 Seat Pad
54 First Leg Press Pivot
56 Second Leg Press Pivot
80 First Link
82 Second Link
84 First Left Link
85 First Right Link
86 Second Left Link
87 Second Right Link
100 Cable System
102 First Cable
104 Second Cable
106 Leg Extension Pulley
108 First Base Pulley
110 Leg Press Pulley
112 Second Base Pulley
114 Third Base Pulley
116 Press Arm Pulley
118 Fourth Base Pulley
120 Fifth Base Pulley
140 Resistance Source

The invention claimed is:

1. An integrated leg press comprising:

a. a base assembly for standing on a floor surface;

b. a leg station supported above the base assembly in a four bar configuration includes a first link and a second link, wherein the leg station further comprises a seat and a leg developer having a leg extension arm mounted on a leg extension pivot at a front end of the leg station;

c. a first base pivot and second base pivot disposed on the base assembly;

d. wherein the first link pivotally connected to a first base pivot at a lower first link end, and connected to a first leg press pivot at an upper first link end, wherein the upper link first end is connected to the leg station;

e. wherein the second link pivotally connected to a second base pivot at a lower second link end, and connected to a second leg press pivot at an upper second link end, wherein the upper link second end is connected to the leg station; and f. a adjustable pedal acting as a foot rest attached to the base assembly opposite the leg developer, whereby the pedal supports a user's feet while the user is positioned on the seat and pushes the pedal with the user's feet by stretching the user's legs.

2. The integrated leg press of claim 1, further comprising: a pad for supporting a user, wherein the pad is mounted between the leg developer and the seat.

3. The integrated leg press of claim 1, wherein the leg station has a starting position relative to the base assembly, wherein the base assembly abuts the leg station in starting position.

4. The integrated leg press of claim 1, further comprising: a cable and a pulley system mounted between the leg station and the base assembly.

5. The integrated leg press of claim 4, wherein the cable starts at a leg extension pulley at a lower end of the leg extension arm, then goes to a first base pulley which is mounted to the base assembly, then goes to a leg press pulley which is mounted to the second link, then goes to a second base pulley, and then goes to a movable weight.

6. The integrated leg press of claim 4, wherein the cable starts at a leg extension pulley at a lower end of the leg extension arm, then goes to a first base pulley which is mounted to the base assembly, then goes to a leg press pulley which is mounted to the second link, and then goes to a movable weight.

7. An integrated leg press comprising:

a. a base assembly for standing on a floor surface;

b. a leg station supported above the base assembly in movable configuration, wherein the leg station further comprises a seat and a leg developer having a leg extension arm mounted on a leg extension pivot at a front end of the leg station; and c. a pedal acting as a foot rest attached to the base assembly in a direction opposite the leg extension arm, wherein the foot rest protrudes rearwardly, and wherein the leg extension arm extends in a direction opposite the pedal, wherein the leg station has a starting position relative to the base assembly, wherein the base assembly abuts the leg station in starting position d. a cable and pulley system mounted between the leg station and the base assembly; wherein the cable starts at a leg extension pulley at a lower end of the leg extension arm, goes to a first base pulley which is mounted to the base assembly, and goes to a movable weight.

8. The integrated leg press of claim 7, further comprising: a pad for supporting a user, wherein the pad is mounted between the leg developer and the seat.

9. The integrated leg press of claim 7, wherein the cable starts at a leg extension pulley at a lower end of the leg extension arm, then goes to a first base pulley which is mounted to the base assembly, then goes to a leg press pulley which is mounted to the leg station, then goes to a second base pulley, and then goes to a movable weight.

10. The integrated leg press of claim 7, wherein the cable starts at a leg extension pulley at a lower end of the leg extension arm, goes to a first base pulley which is mounted to the base assembly, goes to a leg press pulley which is mounted to the leg station, and then goes to a movable weight.

11. An integrated leg press comprising:

a. a base assembly for standing on a floor surface;

b. a leg station supported above the base assembly in movable configuration, wherein the leg station further comprises a seat and a leg developer having a leg extension arm mounted on a leg extension pivot at a front end of the leg station;

c. a pedal acting as a foot rest attached to the base assembly in a direction opposite the leg extension arm, wherein the foot rest protrudes rearwardly, and wherein the leg extension arm extends in a direction opposite the pedal, wherein the leg station has a starting position relative to the base assembly, wherein the base assembly abuts the leg station in starting position, wherein the pedal position is adjustable for accommodating a variety of users of different height; and upper body exerciser attached to the base assembly;

d. a cable and pulley system mounted between the leg station and the base assembly, wherein the cable starts at a leg extension pulley at a lower end of the leg extension arm, goes to a first base pulley which is mounted to the base assembly, and goes to a movable weight.

12. The integrated leg press of claim 11, further comprising: a pad for supporting a user, wherein the pad is mounted between the leg developer and the seat.

13. The integrated leg press of claim 11, wherein the cable starts at a leg extension pulley at a lower end of the leg extension arm, then goes to a first base pulley which is mounted to the base assembly, then goes to a leg press pulley which is mounted to the leg station, then goes to a second base pulley, and then goes to a movable weight.

14. The integrated leg press of claim 11, wherein the cable starts at a leg extension pulley at a lower end of the leg extension arm, goes to a first base pulley which is mounted to the base assembly, goes to a leg press pulley which is mounted to the leg station, and then goes to a movable weight.

* * * * *